US005503295A

United States Patent [19]

Kotarba et al.

[11] Patent Number: 5,503,295

[45] Date of Patent: Apr. 2, 1996

[54] PORTABLE AIR TANK WITH A HAZARD RELIEF VENT

[75] Inventors: Robert J. Kotarba, Springfield; Steve D. Hinsley, Joplin, both of Mo.

[73] Assignee: Midwest Products, Inc., Strattford, Mo.

[21] Appl. No.: 275,963

[22] Filed: Jul. 15, 1994

[51] Int. Cl.[6] ..... F17C 1/00

[52] U.S. Cl. ..... 220/581; 220/89.2; 220/DIG. 6

[58] Field of Search ..... 220/89.2, 581, 220/DIG. 6

[56] References Cited

U.S. PATENT DOCUMENTS

| | | | |
|---|---|---|---|
| 2,339,303 | 1/1944 | Tillery | 220/DIG. 6 |
| 2,356,957 | 8/1944 | Turner | 220/DIG. 6 |
| 4,846,363 | 7/1989 | Gough | 220/581 |
| 4,930,648 | 6/1990 | Hundt | 220/DIG. 6 |

*Primary Examiner*—Joseph M. Moy

*Attorney, Agent, or Firm*—Kokjer, Kircher, Bowman & Johnson

[57] ABSTRACT

A portable air tank having a safety relief venting assembly formed in the bottom of the tank. The safety relief vent includes a tubular relief frame welded to the exterior of the tank about a relief hole punched in the tank's bottom near one end thereof. The tubular relief frame includes a channel therethrough which aligns with, and surrounds, the hole punched in the bottom of the tank. The legs of the tank are formed to maintain the tank in an angled relation, with respect to a horizontal plane, to ensure that condensation within the tank collects at the relief hole. The venting assembly includes a cup-shaped plug inserted into the relief frame. A concave surface of the cup-shaped plug is directed upward toward the interior of the tank to ensure that condensation collects within the cup. The cup-shaped plug is formed with a thickness substantially half that of the tank's outer wall to ensure that the plug will corrode and fail before any other portion of the tank wall is compromised. When the plug fails, air pressure within the tank is discharged through the relief frame and downward against the floor to minimize the danger to the user.

14 Claims, 2 Drawing Sheets

PORTABLE AIR TANK WITH A HAZARD RELIEF VENT

FIELD OF THE INVENTION

The present invention generally relates to a portable air tank and, more specifically, to a portable air tank with a pressure relief vent manufactured therein to prevent ruptures of the tank.

BACKGROUND OF THE INVENTION

In the past, portable air tanks have been proposed which afford the user an easy means of transporting compressed air to a location remote from an air compressor. A portable air tank may be used for a variety of applications, such as inflating low or flat tires and inflating recreational items, such as inflatable sports equipment, inflatable swimming pool toys and the like. The tank is also useful in applications, such as cleaning small appliances and operating small air tools.

Portable air tanks are typically charged (i.e. filled with compressed air) at the air compressor to a desired pressure and stored for future use in a shop or a vehicle. The portable air tank may remain unused, but in a charged state, for an extended period of time. During this time period, moisture from the compressed air in the tank condenses and collects in the base of the tank. Consequently, the user should periodically drain this condensation from the tank to prevent rust and corrosion of the tank's interior.

However, often users fail to drain the tank in a timely manner and consequently the interior of the tank rusts and corrodes. As the walls of the tank corrode, they weaken and this weakness coupled with the air pressure within the tank creates a potential for leakage and possibly rupture. Tank failures, resulting from this type of neglect, create a serious safety hazard since tanks filled with air (for instance to 110 psi) may explode quite violently, thereby projecting shrapnel throughout the surrounding area. This potential problem is further aggravated by the fact that users are often quite unaware of the amount of tank corrosion, and thus unable to gauge the extent to which the tank wall has been compromised and the likelihood of a rupture. The users are unable to visually inspect the corrosion since the condensation is inside the tank and the tank walls rust from the inside out.

The need remains in the industry to overcome drawbacks heretofore experienced and discussed above. The present invention is intended to meet this need.

SUMMARY OF THE INVENTION

It is an object of the present invention to provide a portable air tank which prevents hazardous ruptures of the tank's shell due to internal rust and corrosion.

Another object of the present invention is to provide a portable air tank which executes a controlled discharge of the pressure within the tank after a predetermined amount of corrosion has taken place within the tank.

Another object of the present invention is to provide an air tank with a safety relief plug positioned at a point along the shell of the tank to ensure that the amount of corrosion in the plug corresponds to the greatest amount of corrosion within the tank shell.

It is a further object of the present invention to provide a portable air tank which includes a safety relief plug that is constructed to release air from the tank in a controlled manner.

It is a further object of the present invention to provide a portable air tank which includes a safety relief plug to inform a user that corrosion of the interior wall of the tank has progressed to a predetermined stage and that further corrosion may compromise the tank wall.

These and other objects of the present invention are achieved by a portable air tank having a safety relief venting assembly formed in the bottom of the tank. The safety relief vent includes a tubular relief frame welded to the exterior of the tank about a relief hole punched in the tank's bottom near one end thereof. The tubular relief frame includes a channel therethrough which aligns with, and surrounds, the hole punched in the bottom of the tank. The legs of the tank are formed to maintain the tank in an angled relation, with respect to a horizontal plane, to ensure that condensation within the tank collects at the relief hole. The venting assembly includes a cup-shaped plug inserted into the relief frame. A concave surface of the cup-shaped plug is directed upward toward the interior of the tank to ensure that condensation collects within the cup. The cup-shaped plug is formed with a thickness substantially half that of the tank's outer wall to ensure that the plug will corrode and fail before any other portion of the tank wall is compromised. When the plug fails, air pressure within the tank is discharged through the relief frame and downward against the floor to minimize the danger.

DETAILED DESCRIPTION OF THE DRAWINGS

DETAILED DESCRIPTION OF THE INVENTION

Figure 1:
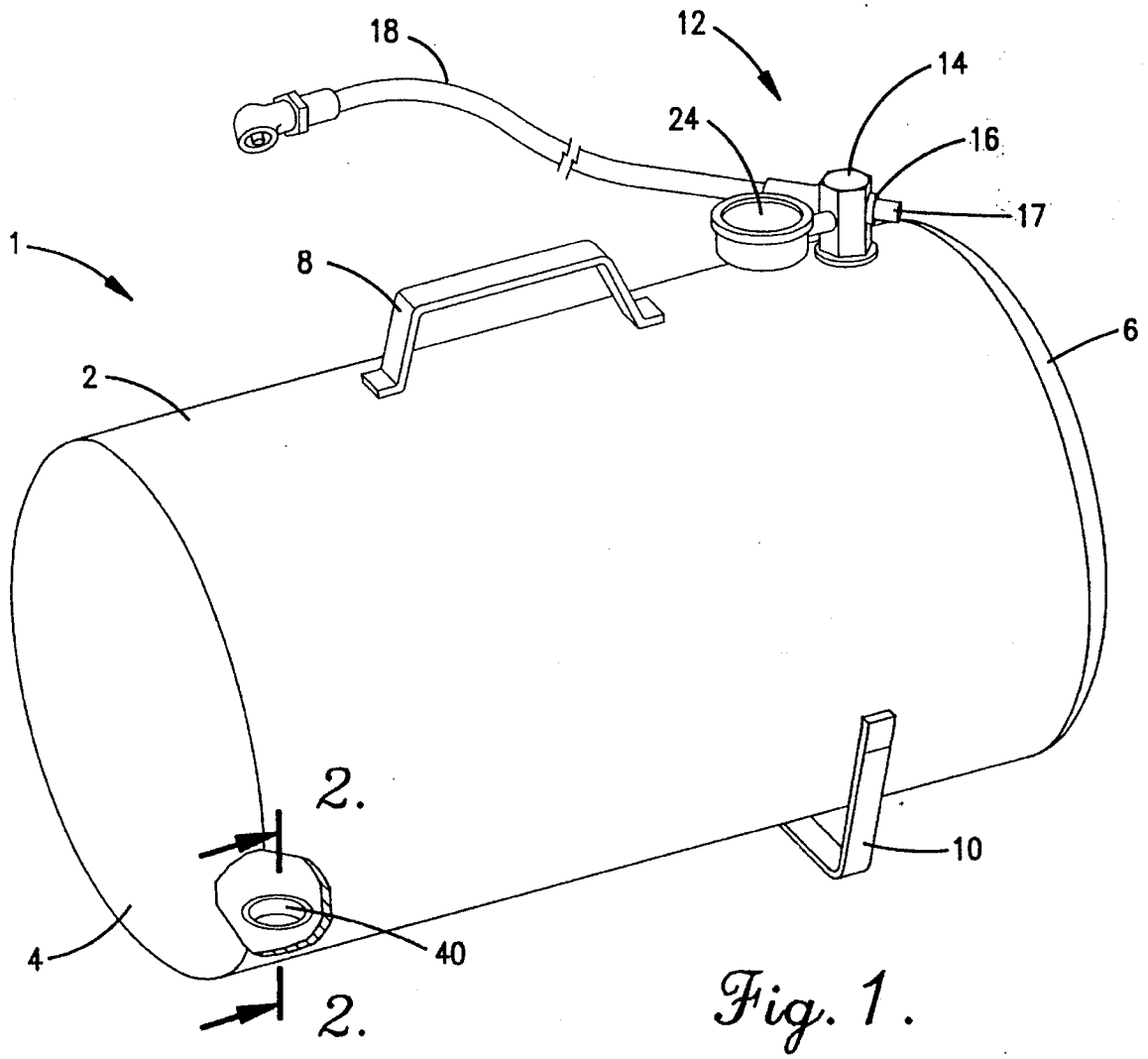
FIG. 1 illustrates a side elevational view of a portable air tank according to the present invention.

Referring to FIG. 1, a portable air tank is generally designated by reference numeral 1. The air tank 1 is formed with a tubular shell 2 having dome shaped end caps 4 and 6 securely fastened to opposite ends thereof. The end caps 4 and 6 and the shell 2 form an air tight chamber. The shell 2 and end caps 4 and 6 may be formed with a baked enamel exterior finish. The interior of the tank is coated with a rust inhibitor. According to the preferred embodiment, the air tank is designed for a working pressure of approximately 125 psi. However, optionally the tank 1 may be formed to operate with a higher or lower working pressure. The tubular shell 2 is securely welded to a handle 8 and front leg 10. The handle 8 is located near the top center of the tank 1 and enables the tank 1 to be conveniently carried. The leg 10, which may be formed of steel, is positioned near one end of the tank 1. The leg 10 is configured to provide a wide stance for the air tank 1 to prevent the tank from rolling and to maintain the tank 1 in an upright position.

An air port mechanism 12 is constructed near the handle 8 along the top of the tank 1. The air port mechanism 12 is attached to provide a sealed relation within a hole (not shown) in a top portion of the outer shell 2 of the tank 1. The air port mechanism 12 includes a discharge port 14 securely welded to the shell 2 about the air discharge hole. An air hose 18 is attached at one end to the discharge port 14 and at an opposite end to a standard air chuck 20. While the preferred embodiment illustrates a standard tire air chuck 20 as being fastened to the air hose, any other known type of chuck may be inserted therein.

A manifold 16 is secured to the discharge port 14. The manifold 16 may be formed of solid brass and is rotated to turn the air supply to the air hose 18 ON and OFF. A fill stem 17 is included proximate the manifold 16 and is used to inject air into the tank 1. The air hose 18 may be constructed from an industrial grade material (having, for instance, a 200 pound test). The discharge port 14 further includes a safety pressure relief valve for releasing air. As a secondary operation, the relief valve also allows condensation within the tank to be drained therefrom when the tank is turned upside down. A pressure gauge 24 is also fastened to the discharge port 14 to provide a visual indication of the air pressure within the tank 1.

Figure 2:
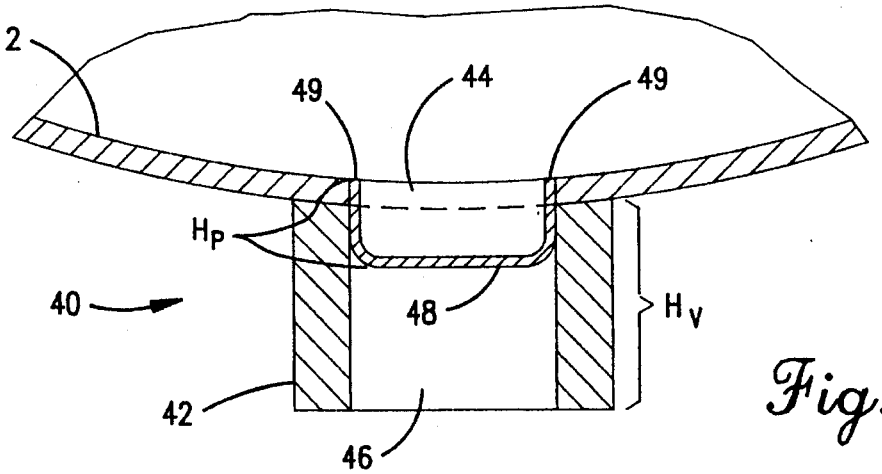
FIG. 2 illustrates a side sectional view along line 2—2 in FIG. 1 of the vent assembly within the portable air tank.

As illustrated in FIG. 2, the shell 2 includes a relief hole 44 punched into a bottom wall of the tank 1. The relief hole 44 is positioned to ensure that condensation within the tank 1 will collect therein. The air tank 1 also includes a safety release vent assembly 40 located on the bottom of the air tank and proximate an end of the tank that is opposite to the leg 10. The vent assembly 40 includes a tubular relief frame 42 securely welded to the exterior of the shell 2. The relief frame 42 is positioned such that a channel 46, extending through the relief frame 42, aligns with the relief hole 44. A cup-shaped plug 48 is press fitted into the channel 46 of the relief frame 42 until its upper tips 49 are partially received within the relief hole 44.

As illustrated in FIG. 2, the cup-shaped plug 48 is oriented such that its concave surface faces toward the interior of the tank 1.

The plug 48 is formed of the same material as the shell 2, such as a low carbon steel, to ensure that the plug and shell corrode at substantially the same rate. The plug 48 is formed with a thickness of approximately ½ the thickness of the shell 2. By way of example only, the plug may have a thickness of approximately 0.03 inches, while the thickness of the tank shell 2 may be 0.06 inches. The diameter of the relief hole 44 may be approximately ½ inch. The relief frame 42 extends outward from the tank 1 by an amount substantially greater than the height Hp of the plug 48. In this manner, when the plug 48 fails and is potentially discharged from the venting assembly 40, the relief frame 42 is able to direct the discharged air and plug 48 along a desired path (i.e. downward towards the floor).

The venting assembly 40 also functions as a foot upon which the tank 1 rests. The height Hv of the venting assembly 40 is less than that of the leg 10 to ensure that, when the tank 1 rests on a level floor, its interior surface is slightly inclined. The vent assembly 40 is positioned at the lower end of this incline to collect the condensation.

During operation, air is injected into the tank 1 through the port 14 until a desired pressure is reached as evidenced by the pressure gauge 24. At some later time, the air is discharged via the air hose 18 and chuck 20. When too much air is injected into the tank, the relief valve may be used to bleed this air off. The manifold 16 allows a user to seal the tank from the air hose by turning the manifold 16, such as when the air hose is being changed.

As explained above, when the tank sits in a charged state, whereby pressurized air is contained therein, moisture within the air condenses on the interior walls of the tank 1. Preferably, the liquid is drained from the tank 1 by inverting the tank 1 and opening the relief valve. Otherwise, this condensation flows to the lowest point within the tank, which corresponds to the region immediately approximate the vent assembly 40. As condensation collects in this region, it runs through the relief hole 40 and is held in the concave section of the cup-shaped plug 48.

Through time, this condensation causes the plug 48 to rust and corrode at the same rate as the surrounding region of the tank's interior wall. To ensure that the plug 48 and shell 2 corrode at the same rate, the cup 48 and shell 2 are formed from the same material. To ensure that the plug 48 fails and ruptures before the shell 2, the plug 48 is formed with a thinner wall than that of the shell 2. When the plug 48 ruptures, the air within the tank is discharged through the channel 46, thereby providing a controlled release of the pressurized air at a known location from the tank and directed along a desired path. The relief frame 42 reinforces the region surrounding the relief hole 44 in order to prevent the region of the tank 1 proximate the hole 44 from splitting and tearing apart as the pressurized air rapidly discharges therethrough.

Typically, ruptures occur in two situations; namely the plug will fail at a low pressure when the user is recharging the tank or the tank may be charged and left for a long period of time during which its interior rusts. Under the latter scenario, a high pressure release may result. However, in either scenario, the plug 48 represents the weakest point along the wall of the tank 1 and thus will fail first. When the plug 48 fails, the plug 48 is discharged from the relief frame 42 along with the air blast in a designed and controlled manner. As the plug 48 includes a thinner wall than that of the shell 2, it is more likely that the plug will rupture at a lower pressure, such as during a recharging operation, as opposed to when the tank is charged to a normal working pressure.

Figure 3:
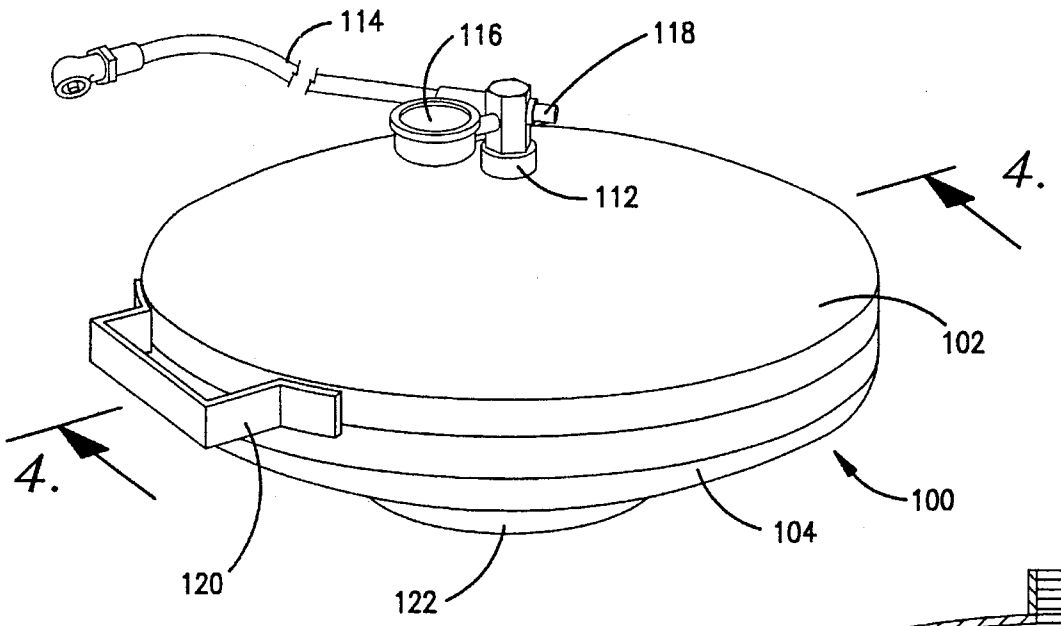
FIG. 3 illustrates a side elevational view of a second embodiment of the present invention.
Figure 4:
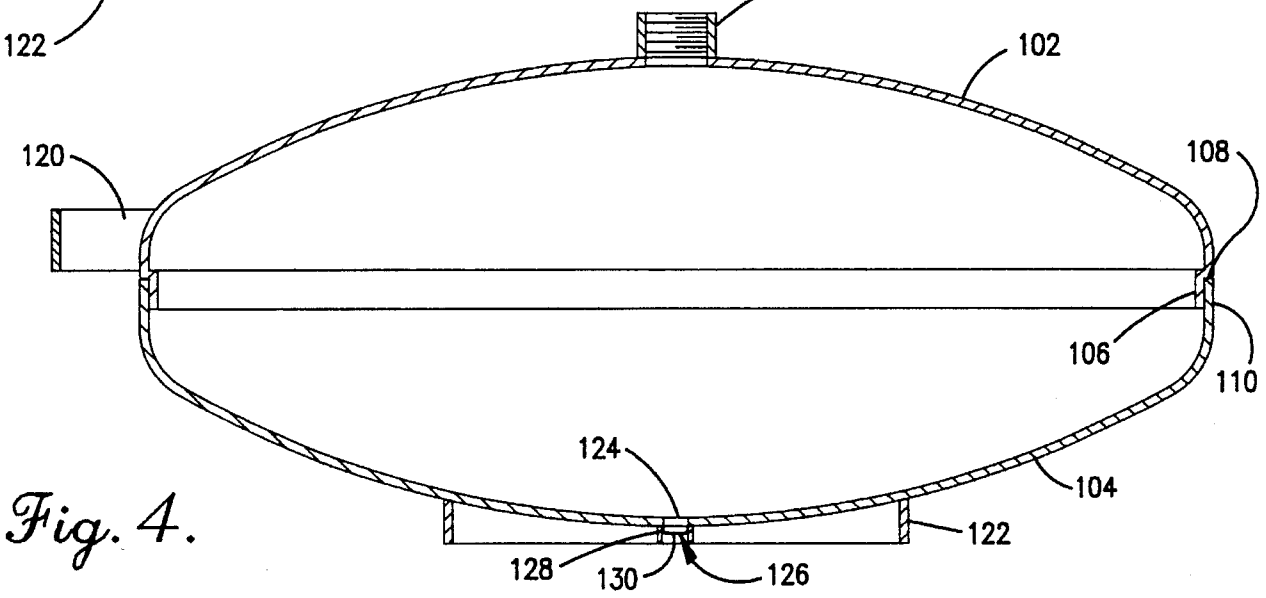
FIG. 4 illustrates a side sectional view along line 4—4 in FIG. 3.

The present relief valve assembly may installed within a variety of tank designs other than that illustrated in FIG. 1. For instance, the relief valve assembly may be installed within an air tank shaped like a pancake as illustrated in FIGS. 3 and 4. The tank 100 of FIGS. 3 and 4 includes top and bottom sections 102 and 104 which are formed in a concave shape. An outer edge 106 of the top section is indented to form a ledge 108 which receives the outer edge 110 of the bottom section 104. A threaded coupler 112 is formed within the top section 102 and receives an air hose 114, a pressure gauge 116, and a relief valve 118. A handle 120 is provided upon one side of the tank 100.

As illustrated in FIG. 4, the bottom section 104 of the tank 100 is securely attached to a circular support 122, such as a band. The support 122 holds the tank 100 in a stationary position. The bottom section 104 includes a relief hole 124 punched therein. The relief hole 124 is positioned to ensure that condensation within the tank 100 will collect therein. A safety release vent assembly 126 is located on the bottom of the air tank proximate its center. The vent assembly 126 includes a tubular relief frame 128 securely welded to the exterior of the bottom shell section 104. The relief frame 128 is positioned such that a channel extending there through aligns with the relief hole. A cup-shaped plug 130 is press fitted into the channel of the relief frame 128 as in the first embodiment until its upper tips are partially received within the relief hole.

As in the first embodiment, the cup-shaped plug 130 is oriented such that its concave surface faces toward the interior of the tank 100. The plug 130 is formed of the same material as the shell, again, to ensure that the plug and shell corrode at substantially the same rate. The relief frame 128 extends outward from the tank 100 by an amount substantially greater than the height of the plug 48 for reasons set forth above in the first embodiment.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A portable air tank for receiving, storing and transporting compressed air therein, the compressed air including moisture that condenses and collects within a lowest region of said tank when said tank positioned upright and is stationary, said tank comprising:

an exterior shell forming a sealed container for storing the compressed air, said shell having a first thickness;

an air port, within said shell, for controllably receiving air therethrough and discharging air therefrom;

support means for maintain said air tank in a substantially upright position when said tank is set in a stationary position; and a safety release assembly, formed in a bottom of said shell, including means to collect the condensation and instantly to discharge all air pressure within said tank when the condensation corrodes said release assembly by a predetermined amount.

2. A portable air tank according to claim 1, wherein said shell includes a hole formed in a bottom thereof, and wherein said safety release assembly includes a plug press fitted therein to close said hole.

3. A portable air tank according to claim 2, wherein said plug is formed of a same material as said shell.

4. A portable air tank according to claim 2, wherein said plug is formed with a thickness less than that of said shell to ensure that said plug fails before said shell.

5. A portable air tank according to claim 2, wherein said plug is formed with a thickness substantially half the thickness of said shell to ensure that said plug fails before said shell.

6. A portable air tank according to claim 1, wherein said shell includes a hole in a bottom thereof and wherein said safety release assembly includes a tubular relief frame secured to an exterior of said shell and surrounding said hole, said relief frame including a channel therethrough which communicates with said hole, said release assembly including a plug press fitted into said relief frame to seal said hole.

7. A portable air tank according to claim 1, wherein said release assembly includes a concave plug snugly received therein and proximate a hole in a bottom of said shell, said plug being oriented such that the concave surface of said plug is facing said hole to receive condensation from said interior of said shell.

8. A portable air tank according to claim 7, wherein said release assembly is securely fastened to an exterior of said shell along a seam, and wherein said concave plug includes outermost tips facing an interior of said shell, said tips isolation said seam from condensation and pressurized air within said shell.

9. A portable air tank according to claim 1, wherein said release assembly includes a corrosion sensitive layer therein to seal a hole punched in said shell, said corrosion sensitive layer having a thickness less that said thickness of said shell to ensure that said corrosion sensitive layer discharges pressurized from said shell before said shell ruptures.

10. A portable air tank according to claim 1, wherein said release assembly includes tubular relief frame welded to an exterior surface of said shell, said relief frame including a channel which communicates with a relief hole punched in said tank, said channel including a corrosion sensitive layer to discharge pressurized air from said shell before said shell ruptures.

11. A portable air tank according to claim 10, wherein said corrosion sensitive layer is formed of a same material as said shell.

12. A portable air tank according to claim 10, wherein said corrosion sensitive layer is formed with a thickness less than that of said shell to ensure that said corrosion sensitive layer fails before said shell.

13. A portable air tank according to claim 10, wherein said shell is formed with a tubular shape.

14. A portable air tank according to claim 10, wherein said shell is formed with a pancake shape.

* * * * *